US006276578B1

(12) United States Patent
Stenger

(10) Patent No.: US 6,276,578 B1
(45) Date of Patent: Aug. 21, 2001

(54) SOCK HOLDING DEVICE

(76) Inventor: Ralph G. Stenger, 27415 60th Ave., Mattawan, MI (US) 49071

( * ) Notice: Subject to any disclaimer, the term of this patent is extended or adjusted under 35 U.S.C. 154(b) by 0 days.

(21) Appl. No.: 09/705,644

(22) Filed: Nov. 3, 2000

(51) Int. Cl.[7] ..... A47G 25/90
(52) U.S. Cl. ..... 223/112; 223/111
(58) Field of Search ..... 223/111, 112, 223/118, 119; D2/642

(56) References Cited

U.S. PATENT DOCUMENTS

| | | | |
|---|---|---|---|
| D. 365,913 | | 1/1996 | Ballard . |
| 3,860,156 | | 1/1975 | Lawrence . |
| 4,482,084 | | 11/1984 | Beskin . |
| 5,050,783 | | 9/1991 | Hunter . |
| 5,636,774 | | 6/1997 | Moscato . |
| 5,687,889 | | 11/1997 | Liden . |
| 5,706,988 | * | 1/1998 | Moore ..... 223/111 |
| 5,924,610 | * | 7/1999 | Willemin ..... 223/112 |

* cited by examiner

*Primary Examiner*—Bibhu Mohanty

(57) ABSTRACT

A sock holding device for aiding a user with putting on socks without bending over. The sock holding device includes a sock holding assembly for holding a sock open for facilitating insertion of a foot into the sock. The sock holding assembly includes a sock holding member which includes a pair of spaced arms. The spaced arms are positioned such that the sock holding member is designed for holding an open end of the sock in an open position. A handle extending from the sock holding member, is elongated such that the handle is designed for minimizing bending of a user while positioning the sock holding member proximate a foot of a user.

5 Claims, 2 Drawing Sheets

SOCK HOLDING DEVICE

BACKGROUND OF THE INVENTION

1. Field of the Invention

The present invention relates to sock holders and more particularly pertains to a new sock holding device for aiding a user with putting on socks without bending over.

2. Description of the Prior Art

The use of sock holders is known in the prior art. More specifically, sock holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,050,783; U.S. Pat. No. 5,636,774; U.S. Pat. No. 5,687,889; U.S. Pat. No. Des. 365,913; U.S. Pat. No. 4,482,084; and U.S. Pat. No. 3,860,156.

While these devices fulfill their respective, particular objectives and requirements, the aforementioned patents do not disclose a new sock holding device. The inventive device includes a sock holding assembly for holding a sock open for facilitating insertion of a foot into the sock. The sock holding assembly includes a sock holding member, which includes a pair of spaced arms. The spaced arms are positioned such that the sock holding member is designed for holding an open end of the sock in an open position. A handle extends from the sock holding member and is elongated such that the handle is designed for minimizing bending of a user while positioning the sock holding member proximate a foot of a user.

In these respects, the sock holding device according to the present invention substantially departs from the conventional concepts and designs of the prior art, and in so doing provides an apparatus primarily developed for the purpose of aiding a user with putting on socks without bending over.

SUMMARY OF THE INVENTION

In view of the foregoing disadvantages inherent in the known types of sock holders now present in the prior art, the present invention provides a new sock holding device construction wherein the same can be utilized for aiding a user with putting on socks without bending over.

The general purpose of the present invention, which will be described subsequently in greater detail, is to provide a new sock holding device apparatus and method which has many of the advantages of the sock holders mentioned heretofore and many novel features that result in a new sock holding device which is not anticipated, rendered obvious, suggested, or even implied by any of the prior art sock holders, either alone or in any combination thereof.

To attain this, the present invention generally comprises a sock holding assembly for holding a sock open for facilitating insertion of a foot into the sock. The sock holding assembly includes a sock holding member, which includes a pair of spaced arms. The spaced arms are positioned such that the sock holding member is designed for holding an open end of the sock in an open position. A handle extends from the sock holding member and is elongated such that the handle is designed for minimizing bending of a user while positioning the sock holding member proximate a foot of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sock holding device apparatus and method which has many of the advantages of the sock holders mentioned heretofore and many novel features that result in a new sock holding device which is not anticipated, rendered obvious, suggested, or even implied by any of the prior art sock holders, either alone or in any combination thereof.

It is another object of the present invention to provide a new sock holding device, which may be easily and efficiently manufactured and marketed.

It is a further object of the present invention to provide a new sock holding device, which is of a durable and reliable construction.

An even further object of the present invention is to provide a new sock holding device which is susceptible of a low cost of manufacture with regard to both materials and labor, and which accordingly is then susceptible of low prices of sale to the consuming public, thereby making such sock holding device economically available to the buying public.

Still yet another object of the present invention is to provide a new sock holding device which provides in the apparatuses and methods of the prior art some of the advantages thereof, while simultaneously overcoming some of the disadvantages normally associated therewith.

Still another object of the present invention is to provide a new sock holding device for aiding a user with putting on socks without bending over.

Yet another object of the present invention is to provide a new sock holding device which includes a sock holding assembly for holding a sock open for facilitating insertion of a foot into the sock. The sock holding assembly includes a sock holding member, which includes a pair of spaced arms. The spaced arms are positioned such that the sock holding member is designed for holding an open end of the sock in an open position. A handle extends from the sock holding member and is elongated such that the handle is designed for minimizing bending of a user while positioning the sock holding member proximate a foot of a user.

Still yet another object of the present invention is to provide a new sock holding device that would aid a user in putting on socks while the user is recovering from a surgery such as a hip replacement.

Even still another object of the present invention is to provide a new sock holding device that would minimize the time and frustration it takes for an elderly or injured user to put on socks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
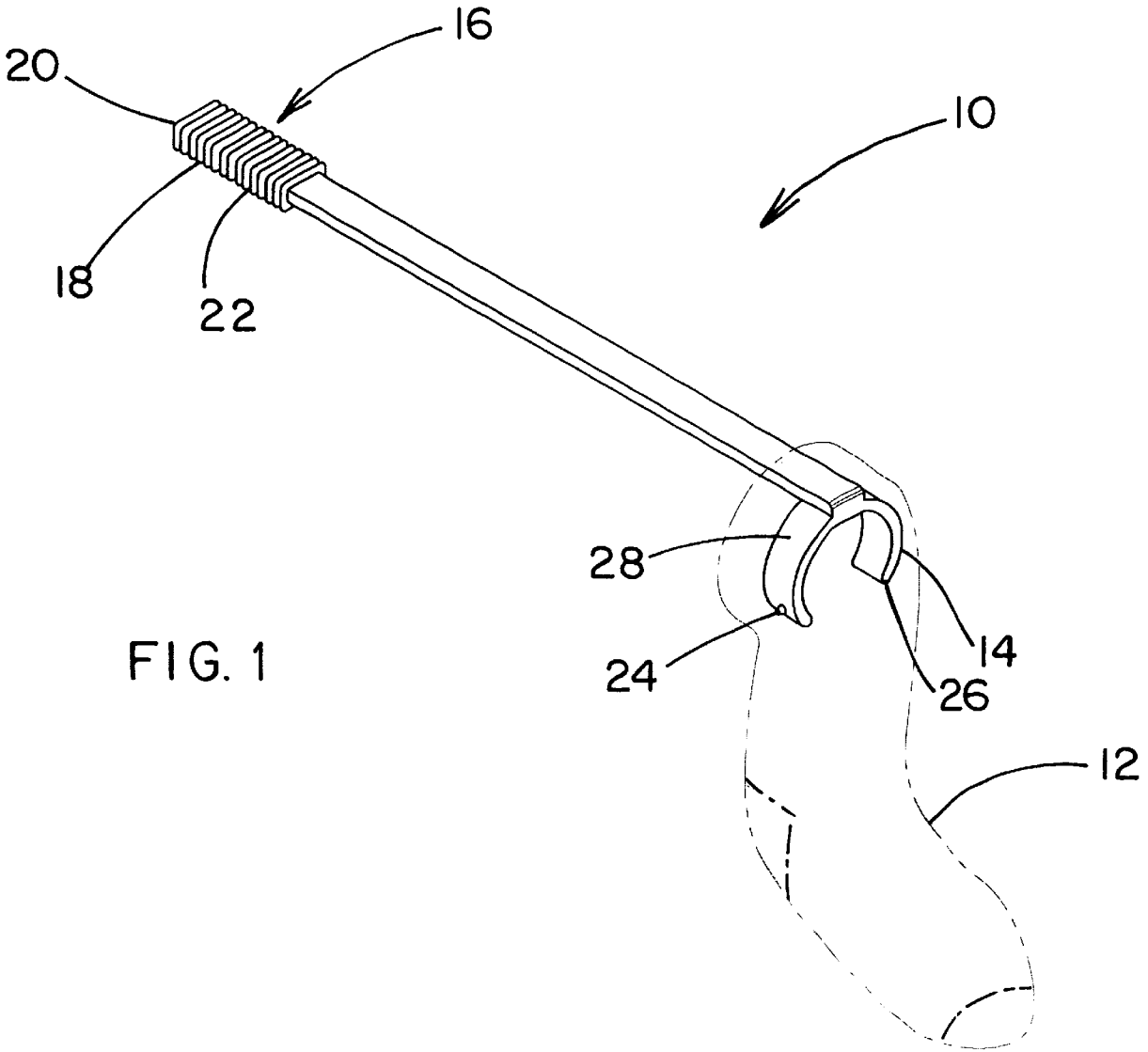
FIG. 1 is a perspective view of a new sock holding device according to the present invention.
Figure 2:
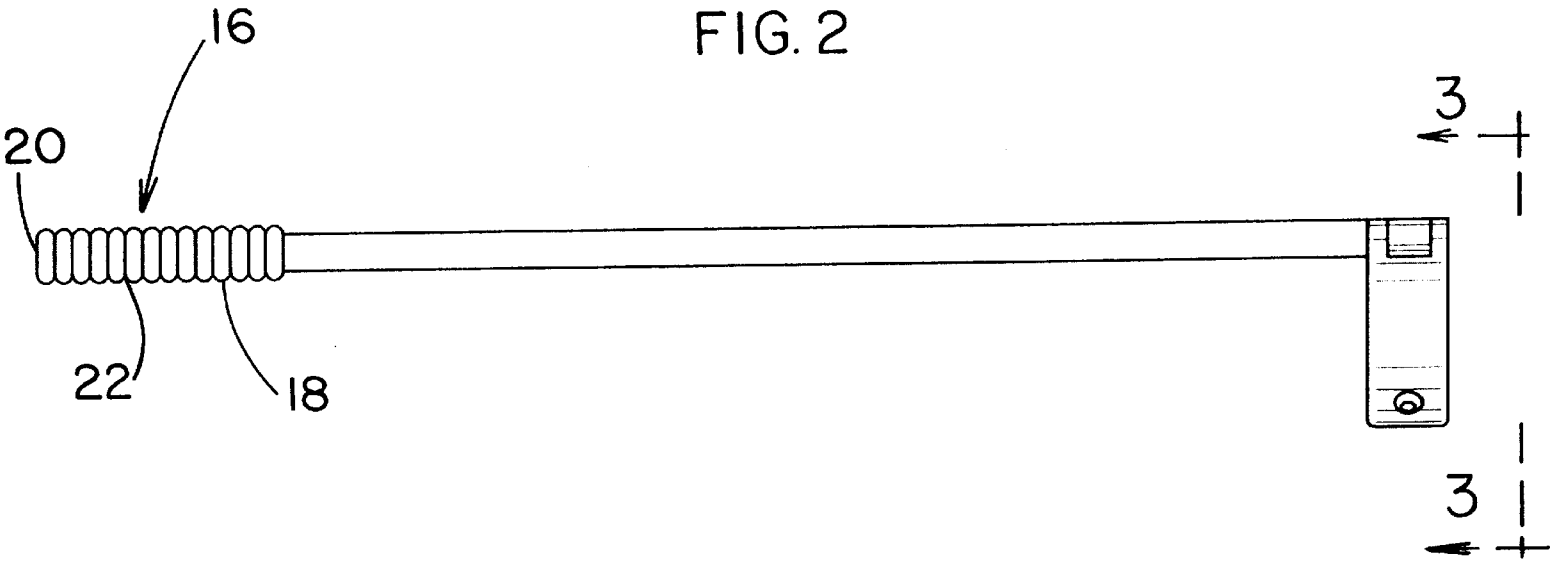
FIG. 2 is a side view of the present invention.
Figure 3:
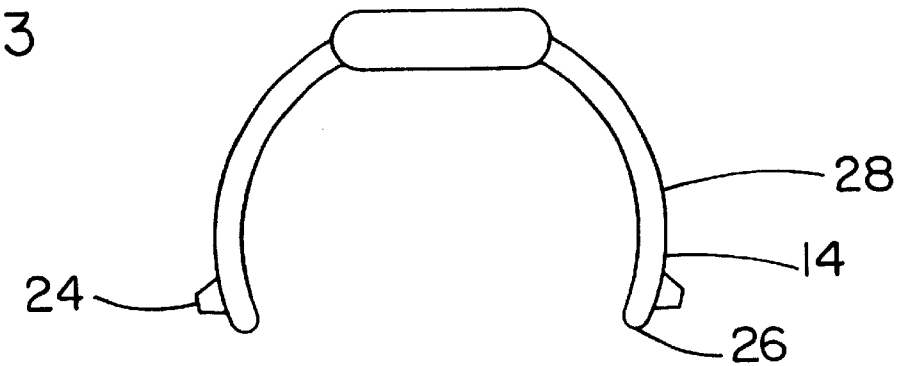
FIG. 3 is a end view of the present invention.

With reference now to the drawings, and in particular to FIGS. 1 through 3 thereof, a new sock holding device embodying the principles and concepts of the present invention and generally designated by the reference numeral 10 will be described.

As best illustrated in FIGS. 1 through 3, the sock holding device 10 generally includes a sock holding assembly for holding a sock 12 open for facilitating insertion of a foot into the sock 12. A sock holding member includes a pair of spaced arms 14, the spaced arms 14 are positioned such that the sock holding member is designed for holding an open end of the sock 12 in an open position.

A handle 16 extending from the sock holding member is elongated such that the handle 16 is designed for minimizing bending of a user while positioning the sock holding member proximate a foot of a user. The handle 16 includes a gripping portion 18 positioned at a distal end 20 of the handle 16. The gripping portion 18 includes a plurality of grooves 22 for facilitating gripping of the gripping portion 18 by the user.

The spaced arms 14 are generally arcuate. A plurality of protrusions 24 extend from the sock holding member. Thus, the sock holding member is designed for engaging the open end of the sock 12. Each of the protrusions 24 are positioned proximate a distal end 26 of an associated one of the spaced arms 14. Each of the protrusions 24 are extending from an exterior face 28 of the associated one of the spaced arms 14.

In an embodiment, the spaced arms 14 are substantially malleable for permitting spreading of the spaced arms 14 for facilitating holding of the sock 12.

In use, a user places the open end of a sock over the end of the spaced arms of the sock holder; then the user engages the open end of the sock with their foot and uses the handle grip portion of the sock holder to pull the sock on.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sock holding assembly for holding a sock open for facilitating insertion of a foot into said sock, said sock holding assembly comprising:

a sock holding member having a pair of spaced arms, said spaced arms being positioned such that said sock holding member is adapted for holding an open end of said sock in an open position;

a handle extending from said sock holding member, said handle being elongated such that said handle is adapted for minimizing bending of a user while positioning said sock holding member proximate a foot of a user;

a pair of protrusions extending from said sock holding member whereby said sock holding member is adapted for engaging said open end of said sock;

each of said protrusions extending from an outer face of an associated one of said spaced arms proximate a distal end of said associated one of said spaced arms, each of said protrusions being offset from edges of said associated one of said spaced arms; and each of said protrusions having a flat distal surface having a round perimeter edge, each of said protrusions further having an angled perimeter wall extending between said associated one of said spaced arms and said perimeter edge of said flat distal surface.

2. The sock holding assembly of claim 1, further comprising:

said handle having a gripping portion positioned at a distal end of said handle, said gripping portion having a plurality of grooves for facilitating gripping of said gripping portion by the user.

3. The sock holding assembly of claim 1, further comprising:

each of said spaced arms being generally arcuate.

4. The sock holding assembly of claim 1, further comprising:

each of said spaced arms being substantially malleable for permitting spreading of said spaced arms for facilitating holding of said sock.

5. A sock holding assembly for holding a sock open for facilitating insertion of a foot into said sock, said sock holding assembly comprising:

a sock holding member having a pair of spaced arms, said spaced arms being positioned such that said sock holding member is adapted for holding an open end of said sock in an open position;

a handle extending from said sock holding member, said handle being elongated such that said handle is adapted for minimizing bending of a user while positioning said sock holding member proximate a foot of a user;

said handle having a gripping portion positioned at a distal end of said handle, said gripping portion having a plurality of grooves for facilitating gripping of said gripping portion by the user;

each of said spaced arms being generally arcuate;

a pair of protrusions extending from said sock holding member whereby said sock holding member is adapted for engaging said open end of said sock;

each of said protrusions extending from an outer face of an associated one of said spaced arms proximate a distal end of said associated one of said spaced arms, each of said protrusions being offset from edges of said associated one of said spaced arms;

each of said protrusions having a flat distal surface having a round perimeter edge, each of said protrusions further having an angled perimeter wall extending between said associated one of said spaced arms and said perimeter edge of said flat distal surface; and each of said spaced arms being substantially malleable for permitting spreading of said spaced arms for facilitating holding of said sock.

* * * * *